United States Patent [19]

Hoenig

[11] Patent Number: 4,542,606

[45] Date of Patent: Sep. 24, 1985

[54] PISTOL STRUCTURE

[75] Inventor: George Hoenig, Boise, Id.

[73] Assignee: Pachmayr Gun Works, Inc., Los Angeles, Calif.

[21] Appl. No.: 513,375

[22] Filed: Jul. 13, 1983

[51] Int. Cl.[3] ..... F41C 5/00; F41C 21/22

[52] U.S. Cl. ..... 42/75 B; 42/77; 42/75 A; 89/196

[58] Field of Search ..... 42/75 B, 77; 89/29, 89/128, 196

[56] References Cited

U.S. PATENT DOCUMENTS

| | | | |
|---|---|---|---|
| 1,563,675 | 12/1925 | Tansley | 89/196 |
| 1,719,384 | 7/1929 | Tansley | 42/70 A |
| 2,776,602 | 1/1957 | Sturtevant | 89/196 |
| 3,504,594 | 4/1970 | Greeley | 89/163 |
| 3,657,959 | 4/1972 | Kart | 89/196 |
| 3,724,326 | 4/1973 | Day | 42/77 |

OTHER PUBLICATIONS

Kart Sporting Arms literature.
Colt .45 Caliber Pistol literature.

*Primary Examiner*—Charles T. Jordan
*Assistant Examiner*—Ted L. Parr
*Attorney, Agent, or Firm*—William P. Green

[57] ABSTRACT

A gun conversion assembly for application to the receiver of an automatic pistol having a handle containing a recess into which a magazine holding a series of rounds of ammunition is insertible, the conversion assembly including a barrel to be secured to the receiver, and a connector structure having a portion which is adapted to be located within the magazine recess in the receiver handle and which acts to secure the barrel rigidly to the receiver. The connector structure may extend downwardly through the recess to the bottom of the receiver handle and have elements at the lower end of the handle tightenable to progressively pull the receiver downwardly into tightly contacting engagement with the upper end of the receiver. The connector structure may also include an expansible combination of parts acting upon the exertion of downward force on the barrel retaining structure to expand laterally to an increased width in a relation tightly bearing against opposite side walls of the receiver recess and enhancing the overall connection between the barrel and receiver. A slide movably mounted to the receiver may be limited in its movement by a detent element carried by the slide and manually releasable to permit removal of the slide from the receiver while the barrel remains attached thereto.

36 Claims, 15 Drawing Figures

PISTOL STRUCTURE

BACKGROUND OF THE INVENTION

This invention relates to improved pistol structures, and particularly to assemblies of parts for converting a pistol such as a Colt .45 caliber automatic pistol to a fixed barrel gun.

Automatic pistols of this type include a slide mounted to the upper side of the receiver of the gun for recoiling movement and acting to automatically eject a shell and feed the next successive round of ammunition into the firing chamber upon each rearward recoiling movement of the slide. The barrel is mounted for limited rearward and downward retraction after the gun is fired, and successive rounds of ammunition are fed to the barrel from a magazine inserted into a recess in the handle of the gun. A problem inherent in effecting conversion of such a gun to a fixed barrel arrangement is that of providing as rigid a connection as possible between the barrel and receiver of the gun for maximizing accuracy and insuring integrity of the pistol over an extended useful life.

SUMMARY OF THE INVENTION

The major purpose of the present invention is to provide an improved conversion arrangement for an automatic pistol of the above discussed general type, with the converted gun including a connection between the barrel and receiver of the gun having greater strength and rigidity than has been attained by prior devices, to allow optimum accuracy and extended reliability of the converted gun, and to do so with a very simple structure. Further, a gun converted by the apparatus of the present invention can be very easily returned to its original condition when desired for use as an automatic pistol. A particular feature of the invention resides in the fact that the conversion is attained without requiring any alteration of the main receiver or frame of the pistol, so that when the parts in converting the gun are detached and the original slide and other elements of the automatic pistol are reconnected to the receiver, the structure of the reconverted automatic pistol is exactly as it was before the conversion was made.

The advantages of the present arrangement are attained in large part by provision of a specially designed barrel assembly to be substituted for the original barrel of the automatic pistol, together with a unique connector structure which secures the barrel assembly to the receiver and is very effectively anchored to the receiver by extension of the connector parts downwardly from the barrel into the recess in the receiver which normally contains the ammunition magazine of the automatic pistol. Preferably, the connection includes a rod or other elongated element projecting downwardly through the recess in the handle portion of the receiver and to the lower end of the handle, and there connected to a bottom part which applies upward force to the handle to maintain the connection. A tightening element at the underside of the handle may by rotation tighten the connection to pull the barrel downwardly against the upper portion of the receiver.

The integrity of the connection may be further enhanced by forming the connector structure within the recess in the pistol receiver with an expansible portion which tends upon exertion of downward force on the connector structure to expand to an increased width condition in which it applies force in opposite lateral directions against two opposite side walls of the recess, to thus assure against any lateral shifting movement of the barrel and connector structure relative to the receiver after the connection has been completed. This expansible portion of the connector structure may include two camming elements which are automatically cammed laterally relative to one another upon tightening of the connection between the parts to bear against the side walls of the recess in the receiver.

The converted gun may include a slide mounted for front to rear movement relative to the barrel and receiver, and preferably carrying a manually actuated bolt for closing the rear end of the receiver during firing.

An additional feature of the invention relates to the provision of an element to be received at the underside of the barrel, and vertically between the barrel and receiver, at a location forwardly of the main connection between these parts. This element is desirably attached to the receiver by a projection extending rearwardly from the element and containing an opening through which a pin connected to the receiver extends. This pin may be a portion of the slide stop member normally present in an automatic gun of the discussed type.

BRIEF DESCRIPTION OF THE DRAWINGS

The above and other features and objects of the invention will be better understood from the following detailed description of the typical embodiments illustrated in the accompanying drawings in which.

DESCRIPTION OF THE PREFERRED EMBODIMENTS

Figure 1:
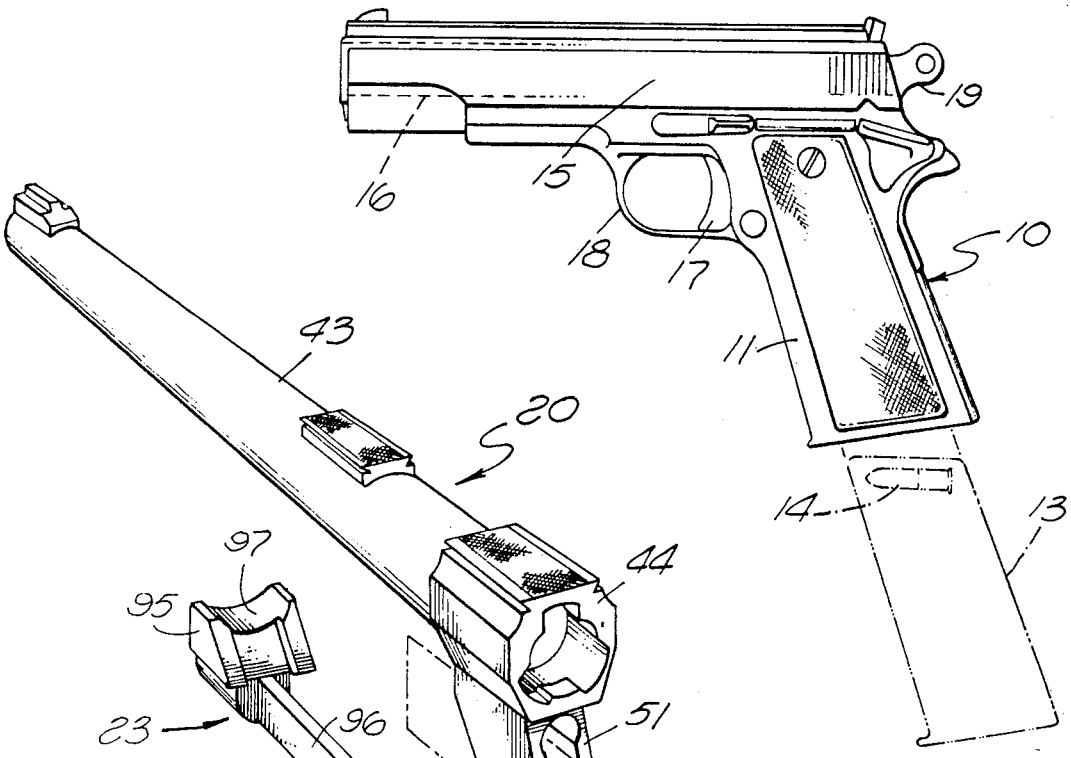
FIG. 1 (PRIOR ART)
FIG. 1 is a side elevational view, partially in section, of a Colt Model "O" .45 caliber automatic pistol as it appears prior to conversion in accordance with the present invention.

The conventional Colt Model "O" .45 caliber automatic pistol which is illustrated in FIG. 1 as it appears before conversion in the manner contemplated by the present invention includes a main receiver or frame 10 having a handle portion 11 containing a magazine recess 12 within which a magazine 13 containing a series of rounds of ammunition 14 is received. Recess 12 extends generally vertically within handle portion 11 of the receiver, and is open at its lower end to allow the magazine to be inserted upwardly into the recess from the broken line position of FIG. 1.

Figure 2:
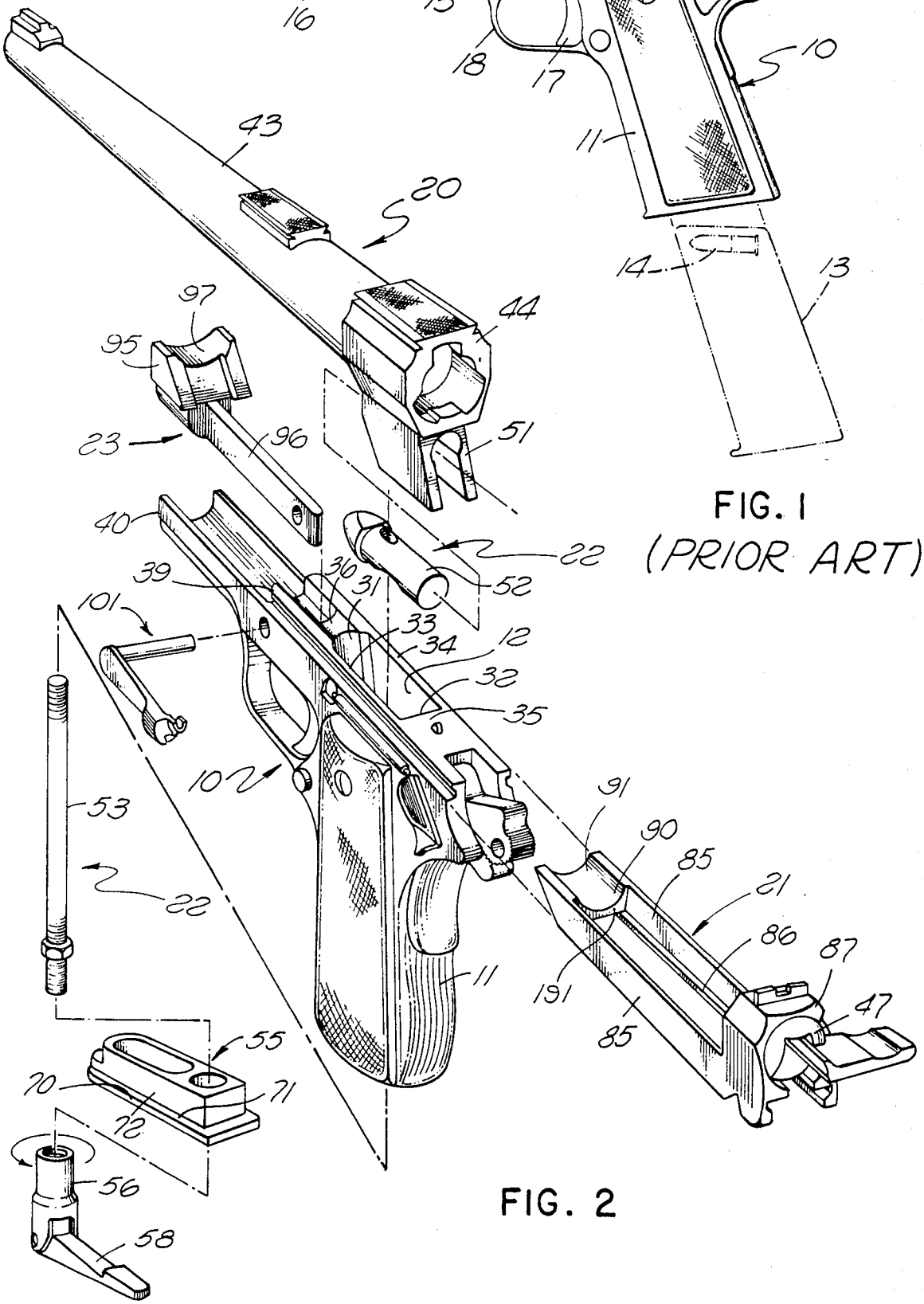
FIG. 2 is an exploded perspective view showing the receiver of the FIG. 1 pistol after detachment of the barrel, slide, and other related parts therefrom, and showing also in FIG. 2 in conjunction with the receiver the parts which are utilized for converting the gun pursuant to the invention.
Figures 3, 3A, 4, 5:
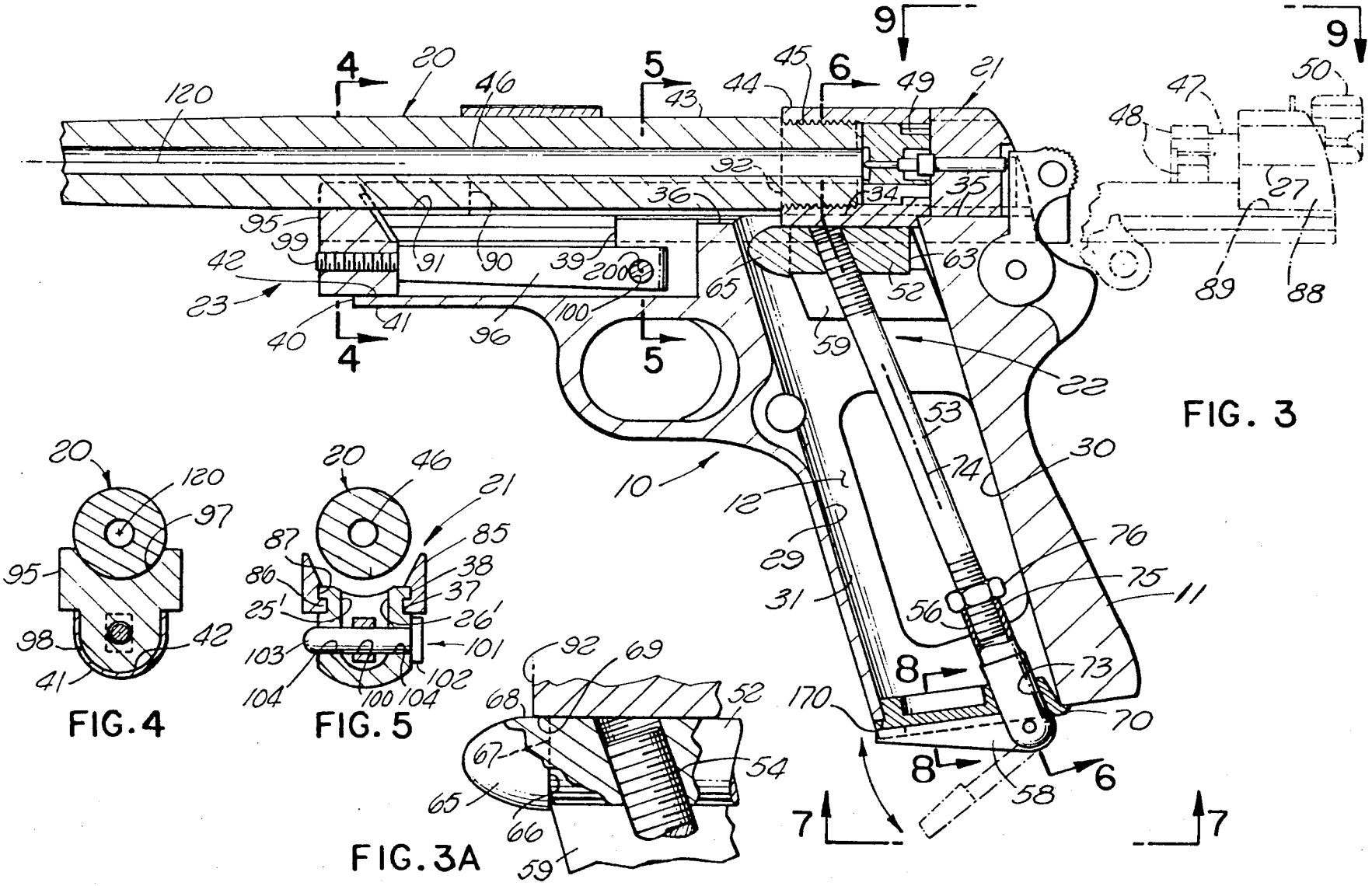
FIG. 3 is a vertical front to rear section through the converted gun.
FIG. 3A is an enlargement of a portion of FIG. 3.
FIGS. 4, 5 and 6 are vertical sections taken on lines 4—4, 5—5 and 6—6 respectively of FIG. 3.

At its upper side, receiver 10 carries a slide 15 which is mounted to the receiver for front to rear recoiling movement when a round is fired within barrel 16. In the standard Colt automatic pistol, the barrel recoils slightly rearwardly and downwardly when the round is fired. The gun is fired by a trigger 17 within a trigger loop portion 18 of the receiver, with the trigger acting to release the hammer 19 to fire the round. In FIG. 3, the receiver 10 is shown with the slide 15, barrel 16, magazine 13 and other related parts removed therefrom, and with the elements of a conversion kit embodying the present invention attached to the receiver. As illustrated in exploded form in FIG. 2, these parts include a barrel assembly 20, a slide 21, connector structure 22 for attaching the barrel assembly rigidly to the receiver, and a unit 23 received between a forward portion of the receiver and the underside of the barrel.

The magazine receiving recess 12 in handle portion 11 of receiver 10 extends along an axis 24 which may be inclined to advance forwardly as it advances upwardly. The recess is of essentially uniform cross-section transversely of axis 24, and is defined at its opposite sides by two parallel side walls 25 and 26 having parallel vertical inner wall surfaces 27 and 28 which are disposed parallel to axis 24 of the magazine recess and axis 120 of barrel 20. The front and rear of the recess are defined by transverse forward and rear walls 29 and 30 of the receiver, with the former of these having a curving wall surface 31 at the front of the recess, and with the rear transverse wall 30 having a planar surface 32 at the back of the magazine recess. At the upper ends of walls 25, 26 and 30, the receiver has a planar horizontal upper surface with portions 33 and 34 extending in a front to rear direction along opposite sides of the magazine recess, and with a portion 35 of the same upper horizontal surface extending transversely across the back of the recess. The upper surface 36 of front wall 29 of the recess may be curved concavely and partial cylindrically as illustrated in FIG. 2. At their outer sides, side walls 25 and 26 of the receiver form horizontally extending grooves 37 and ribs 38 (FIG. 6) which extend parallel to axis 120 of the barrel to guide slides 15 and 21 for a front to rear movement relative to the receiver. As seen in FIG. 5, the receiver at a location forwardly of transverse portion or wall 29 may form forward continuations 25' and 26' of the two side walls 25 and 26 of the magazine recess, with grooves 37 and ribs 38 continuing forwardly to the plane of FIG. 5 and a short distance forwardly therebeyond. Between the locations 39 and 40 of FIG. 3, the receiver may have a forward portion 41 containing an upwardly facing approximately semicylindrical recess 42 of the cross sectional configuration illustrated in FIG. 4.

The barrel assembly 20 of the conversion kit may be formed sectionally to include a barrel proper 43 and a part 44 secured rigidly to the rear end of barrel 43 by a threaded connection 45. Alternatively, the two elements 43 and 44 may if desired be formed integrally of a single piece of metal. A projectile fired by the gun is discharged through bore 46 in the barrel. During firing, the rear end of the barrel assembly is closed by a bolt 47 carried by the rear portion of slide 21. This bolt may be of conventional construction, having a number of circularly spaced lugs 48 engageable with mating lugs 49 formed within part 44 to rigidly retain the bolt in barrel closing and sealing position within part 44. The bolt is actuable between active and released positions by manually turning it relative to the slide about axis 27 by means of an actuating handle 50 and then pulling it rearwardly.

Figure 6:
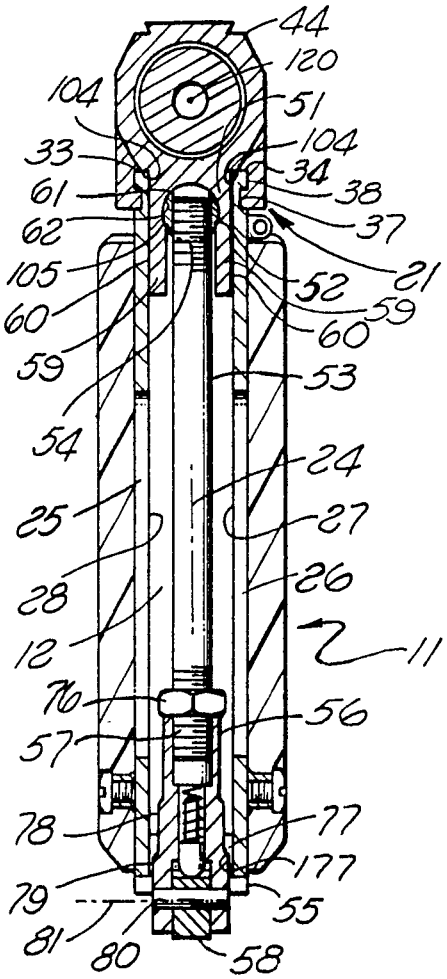
Figure 7:
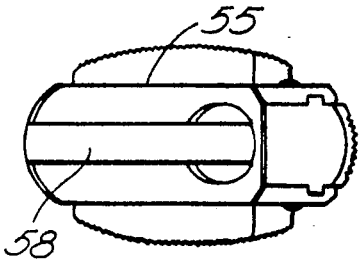
FIG. 7 is a bottom view of the handle of the converted gun, taken on line 7—7 of FIG. 3.
Figure 8:
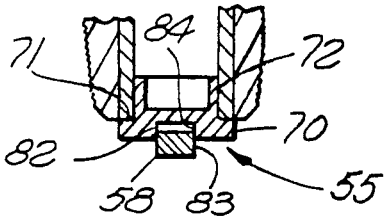
FIG. 8 is a fragmentary vertical section taken on line 8—8 of FIG. 3.
Figure 10:
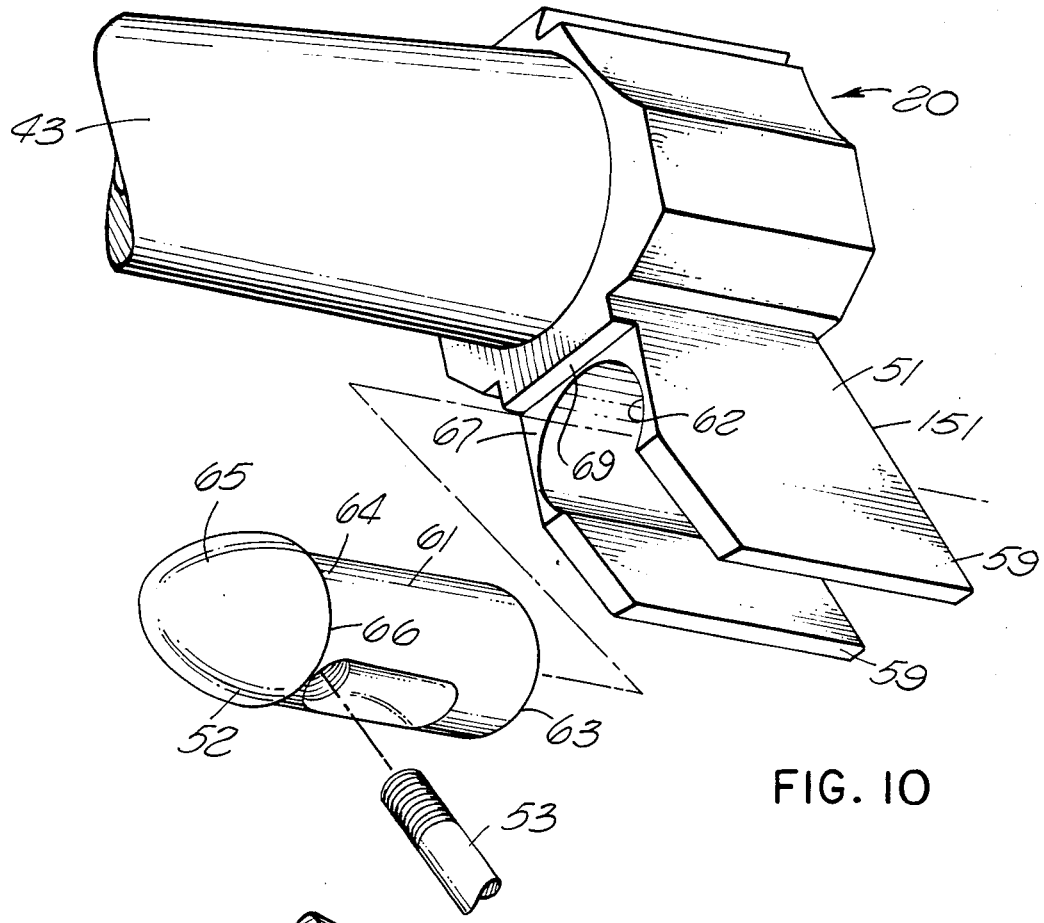
FIG. 10 is a perspective view of the rear portion of the barrel of the FIG. 3 device and related parts.
Figure 14:
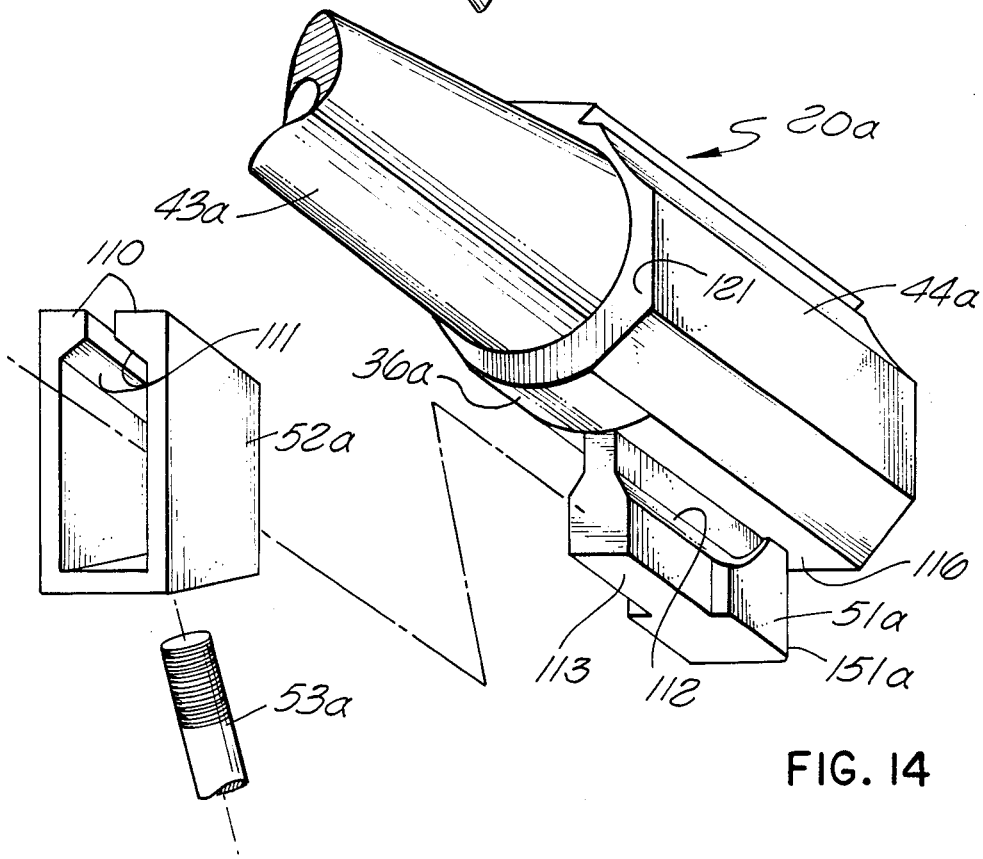
FIG. 14 is an exploded perspective view similar to FIG. 10 but showing the variational arrangement of FIG. 11.
Figure 11:
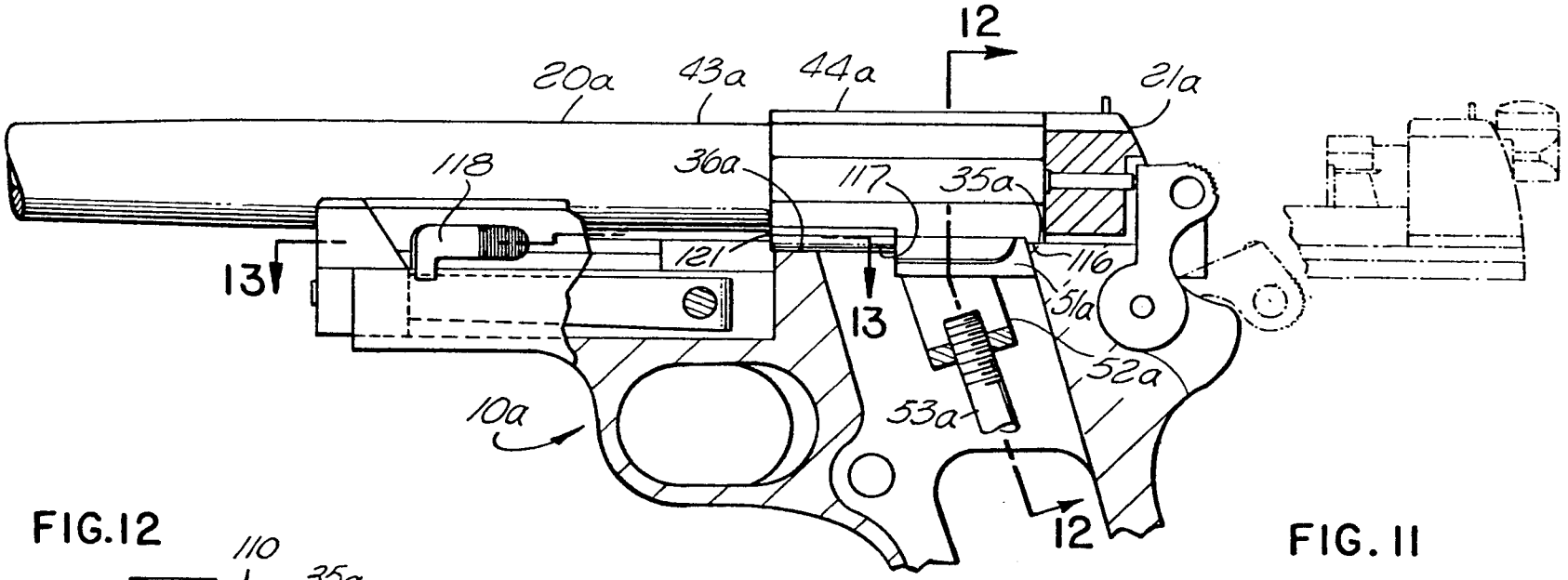
FIG. 11 is a fragmentary front to rear sectional view similar to a portion of FIG. 3, but showing a variational form of the invention.
Figure 13:
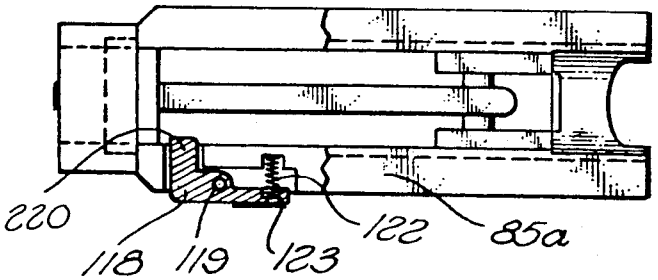
FIG. 13 is a fragmentary horizontal section taken on line 13—13 of FIG. 11.

The connector structure 22 for securing the barrel assembly to the receiver includes an assembly of parts which project downwardly from the barrel assembly into and through magazine recess 12 in receiver 10 to clamp the rear element 44 of the barrel assembly downwardly against the upper surface of the receiver. These parts of the connector structure include a projection 51 secured rigidly to part 44 of the barrel assembly and preferably formed integrally therewith and extending downwardly into the upper end of the magazine recess. Coacting with projection 51, the connector structure includes a connecting element 52, an elongated rod 53 threadedly connected at 54 to element 52, a bottom plate 55 extending across the lower end of the magazine recess in the receiver, a member 56 threadedly connected at 57 to the lower end of rod 53, and an actuating handle 58 for turning part 56. Projection 51 is bifurcated (FIG. 10) to form two spaced downwardly projecting walls 59 having outer planar surfaces 60 engaging and adapted to bear tightly against side wall surfaces 27 and 28 of the magazine recess in receiver 10. Element 52 is received between the two walls 59, and is configured to exert downward force on the walls and at the same time cam them laterally apart and against surfaces 27 and 28. For this purpose, element 52 has a portion with an externally cylindrical surface 61 engaging a correspondingly cylindrical surface 62 formed within projection 51 at the inner sides of walls 59. The cylindrical surface 61 of element 52 extends from one end 63 of that part to the location 64 of FIG. 3, with the element 52 having a slightly enlarged convexly rounded forward portion 65 beyond the location 64. Element 52 is inserted rearwardly into the space between walls 59 of projection 51, to the FIG. 3 position in which a transverse essentially annular shoulder 66 on the forward enlarged portion 65 of element 52 engages a forward vertical planar surface 67 of projection 51. A small upper horizontal flat surface 68 may be formed on the enlarged portion 65 of element 52 to engage a flat horizontal undersurface 69 formed on projection 51 and thereby retain element 52 against rotation from a position in which the axis of its threads 54 lies in a proper vertical plane for connection to rod 53. The lower portions of walls 59 of projection 51 are spaced apart sufficiently to allow the rod 51 to project downwardly therebetween as seen in FIG. 6.

Bottom plate 55 is shaped to extend across and close the lower end of magazine recess 12 in receiver 10, and has a peripheral flange 70 extending along the opposite sides, front and rear of bottom plate 55 to form upwardly facing shoulder surfaces 71 engageable upwardly against the bottom edge surfaces 170 of the receiver about recess 12 in a manner applying upward force to the receiver and limiting upward movement of bottom plate 55 relative to the receiver. Above flange 70, the bottom plate may have a portion 72 projecting upwardly into the recess and fitting closely therein to locate plate 55 against horizontal movement relative to the receiver handle.

Part 56 extends upwardly through an inclined passage 73 formed in bottom plate 55, with that passage being disposed at an inclination corresponding to that of axis 74 of rod 53. Rod 53 is threadedly connected into a passage in part 56 at 75, and may be locked in a desired setting relative to part 56 by a jam nut 76 threadedly connected onto the rod and tightenable against the upper end surface of part 56. An annular shoulder 77 formed on part 56 between an externally cylindrical portion 78 and a larger diameter externally cylindrical lower portion 79 of part 56 engages a corresponding annular shoulder 177 on bottom plate 55 to apply upward force from part 56 to plate 55 when part 56 and rod 53 are turned relative to element 52. Handle part 58 is pivotally connected to part 56 by a transverse pin 80 for relative pivotal movement about the axis 81 of the pin between the full line locking position of FIG. 3 and the broken line released position of that figure. In the locking position of FIG. 3, handle 58 is received within a groove 82 formed in the underside of bottom plate 55 and extending in a front to rear direction relative to the gun, with the vertical side surfaces 83 of the handle engaging vertical side walls 84 of the groove to lock the handle and thus part 56 against rotation about axis 74 of rod 53.

Figure 9:
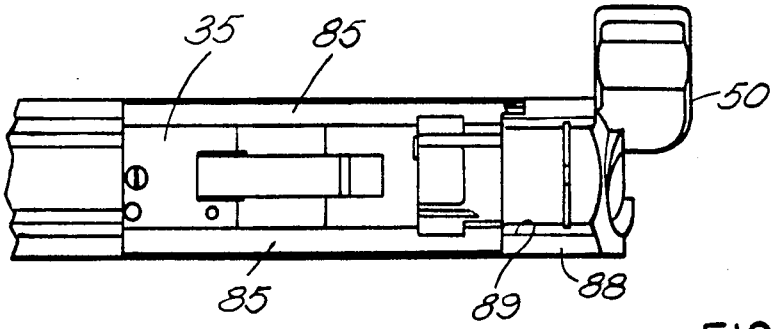
FIG. 9 is a fragmentary plan view taken on line 9—9 of FIG. 3, and showing the slide and bolt in their retracted positions.

Slide 21 may be formed of a single piece of metal having two parallel side rail portions 85 received at the outer sides of the two side walls 25 and 26 of receiver 10 and having ribs 86 adapted to project into grooves 37 of the receiver, and grooves 87 adapted to receive ribs 38 of the receiver in a manner guiding slide 21 for front to rear sliding movement relative to the receiver between the active firing position of FIG. 3 in which bolt 47 closes the rear end of the barrel assembly and the rearwardly retracted position of FIG. 9 in which the chamber is open for removal of a spent shell from the rear end of the barrel and loading of another round thereinto. The bolt is mounted to the slide by reception within a portion 88 of the slide interconnecting side rails 85 at their rear ends, this portion 88 containing a passage 89 within which the bolt is carried for limited rotary movement relative to portion 88 about axis 27. At their forward ends, the side rails 85 of the slide are connected together by a transverse portion 90 of the slide, having an upper surface 91 curved cylindrically in correspondence with the undersurface of barrel 43 to engage that undersurface and move slidably relative to the barrel. In the rearmost position of the slide (FIG. 9), a vertical rear shoulder surface 191 (FIG. 2) on portion 90 of the slide engages a vertical forward surface 92 on the rear part 44 of the barrel assembly to prevent further rearward movement of the slide.

The unit 23 at the underside of the barrel includes a forward member 95 and a connector part 96 rigidly secured thereto. Part 95 has the vertical sectional configuration illustrated in FIG. 4, with an upper partial cylindrical surface 97 curved in correspondence with and adapted to engage the external surface of barrel 43. At its undersurface, part 95 has an essentially semi-circularly curved surface 98 dimensioned to fit closely within the previously mentioned curved surface 42 formed in the forward portion of the receiver to locate part 95 relative thereto. The element 96 may be rigidly connected to part 95 in any convenient manner, as by a threaded connection at 99. Element 96 projects rearwardly from the part 95, and contains a cylindrical opening 100 whose axis 200 extends horizontally and lies within a vertical plane disposed transversely of axis 120 of the barrel. The usual slide stop member 101 which is present in the standard automatic pistol as represented in FIG. 1 interfits with this opening 100 in unit 23 to lock that unit in fixed position relative to the receiver. As seen in FIG. 5, the slide stop has a portion 102 received adjacent the outer surface of the receiver and carrying a cylindrical pin portion 103 which extends through and is a close fit within circular opening 100 in unit 23 and in two aligned openings 104 formed in the opposite side portions of the receiver.

In converting the gun of FIG. 1 to the condition of FIG. 3, the first step is to remove the slide, barrel, etc. of the original gun from receiver 10, after which unit 23 may be positioned in the forward portion of the receiver in its FIG. 3 position and locked therein by insertion of pin 103 of slide stop 101 through the opening 100 in member 96 of unit 23. With the hammer 19 of the gun cocked rearwardly, slide 21 may then be inserted forwardly relative to the receiver, with the ribs and grooves 37, 38, 86 and 87 interfitting as discussed. Connecting element 52 may then be inserted rearwardly between walls 59 of projection 51 at the underside of barrel assembly 20, after which the barrel assembly can be moved downwardly relative to the receiver to move projection 51 and element 52 downwardly into the upper end of magazine recess 12. Rod 53 can then be inserted upwardly through the opening in bottom plate 55, with the rod connected to part 56 as illustrated in FIG. 3, and this entire assembly can be moved upwardly into the magazine recess to bring the upper threaded end of the rod into engagement with the threaded bore in connecting element 52. Part 56 and rod 53 are then turned by rotation of handle 58, with the handle in its broken line position of FIG. 3, so that by virtue of the threaded connection 54 between the rotating rod 53 and the non-rotating connecting element 52 the rod and part 56 are progressively pulled upwardly relative to the receiver. This upward force is applied to bottom plate 55 by part 56, with the rotation being continued until the bottom plate is in tight engagement with the lower end of the recess, and rear part 44 of the barrel assembly is pulled tightly downwardly against the upper horizontal surfaces 33 and 34 of the receiver. To attain effective and rigid engagement between the barrel assembly and receiver, part 44 of the barrel assembly has two horizontal planar surfaces 104 at opposite sides of the magazine recess for engaging and abutting tightly downwardly against magazine surfaces 33 and 34.

As the connecting element 52 is pulled downwardly, the inclined disposition of the engaging cylindrical surfaces of element 52 and walls 59 of projection 51 (at 105 in FIG. 6) causes these surfaces to function as camming surfaces acting to progressively force walls 59 relatively apart to an increased width condition in which the outer surfaces 60 of walls 59 bear very tightly against side wall surfaces 27 and 28 of the magazine recess to enhance the effectiveness of the rigid interconnection between the barrel assembly and receiver.

When the rod 53 and connected parts have been turned to a position in which the desired rigid connection between the barrel assembly and receiver has been attained, handle 58 is swung upwardly from its broken line position of FIG. 3 to its full line position of that figure in which the handle is received within groove 82 and bottom plate 55 to lock the parts in that adjusted position. The threaded connection between rod 53 and part 56 is preadjusted to a condition in which the handle will in the properly tightened condition of the parts be aligned vertically with and move upwardly into groove 82, with jam nut 76 being utilized for locking the rod and part 56 in this desired relative setting.

Since the conversion of the gun as discussed above does not alter the construction of any of the parts of the original pistol, the gun may at any time be easily reconverted to its original condition by removal of the parts of the conversion kit and reassembly of the standard parts on the receiver.

Figure 12:
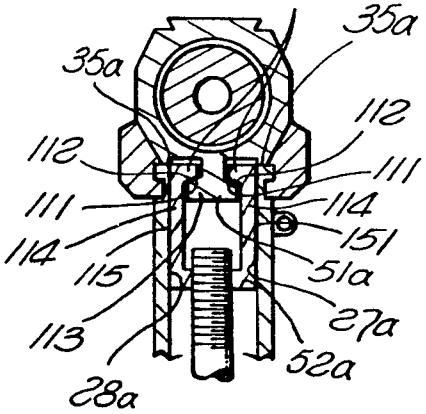
FIG. 12 is a fragmentary essentially vertical transverse section taken on line 12—12 of FIG. 11.

The variational form of the invention illustrated in FIGS. 11 through 14 is essentially the same as that of FIGS. 2 through 10 except with regard to the manner of connection of the barrel assembly 20*a* to the receiver, and the construction of the forward portion of slide 21*a*. In FIGS. 11 through 14, the rear part 44*a* of the barrel assembly, which corresponds to part 44 of the first form of the invention and is threadedly connected to the rear end of the barrel proper 43*a*, has a projection 51*a* at its underside which engages a connecting element 52*a* in camming relation. Rod 53*a* may be the same as the rod 53 of the first form of the invention, and be connected at its lower end to elements identical with those represented at 55, 56, 58 and 76 for engaging the lower end of the receiver 10*a* and applying upward force thereto. As seen in FIG. 12, element 52*a* is of U-shaped configuration, for receiving projection 51*a* therebetween, and is shaped at its upper end to have two portions 110 projecting toward one another and having inclined camming undersurfaces 111 engageable with correspondingly inclined surfaces 112 formed on an enlarged lower portion 113 of projection 51*a*, so that part 52 can pull projection 51 and the magazine downwardly against the upper edge of the magazine, with the camming surfaces 111 and 112 acting to spread the opposite side portions 114 of part 52*a* relatively laterally apart upon exertion of such downward force, causing the parallel vertical outer planar surfaces 115 of portions 114 to bear tightly against the side wall surfaces 27*a* and 28*a* of the magazine recess in the receiver and thereby assure rigid interconnection of the barrel assembly and receiver. When the parts have been pulled to a properly tightened condition, the handle 58 at the lower end of rod 53*a* can be swung to locking position as in the first form of the invention.

In the form of the invention illustrated in FIGS. 11 through 14, the downward force exerted by part 44*a* of the barrel assembly on the receiver is applied to the receiver through surfaces on part 44*a* and the receiver engaging in front of and behind the magazine recess 12*a*. These surfaces include a downwardly facing horizontal surface 116 formed on the rear portion of part 44*a* and extending across that rear portion of the part behind projection 51*a* and engaging downwardly against upwardly facing surface 35*a* on the receiver. In front of projection 51*a*, part 44*a* has a curved surface 117 engaging the concavely curved upwardly facing surface 36*a* formed on the receiver at that location. In this form of the invention, the part 44*a* preferably does not contact the upper edge surfaces extending along opposite sides of the magazine recess and corresponding to surfaces 33 and 34 referred to in describing the first form of the invention.

Slide 21*a* of the second form of the invention may be the same as the slide used in the first form of the invention except for deletion of the transversely extending portion 90 at the front of the slide. Such omission of this portion allows the slide to be removed rearwardly from the receiver while the barrel remains attached thereto. In order to limit this rearward movement except when removal is desired, one of the side rails 85*a* of the slide carries a detent element 118, which is connected to the side rail by a pin 119 for pivotal movement about a vertical axis relative to the side rail, and which has a portion 220 projecting laterally inwardly beyond the inner surface of the side rail to a position for engagement with forwardly facing shoulder 121 on part 44*a* of the barrel assembly to prevent rearward movement of the slide beyond the position in which portion 220 engages shoulder 121. A spring 122 yieldingly holds the detent element in its active position for limiting rearward movement of the slide, and the detent can be pivoted to a position in which its portion 220 will not engage shoulder 121 and can move rearwardly past that shoulder by manual inward depression of a portion 123 of the detent element against the tendency of spring 122.

In assembling the arrangement of FIGS. 11 through 14, unit 23 is first connected to the receiver in the same manner as discussed in connection with the first form of the invention, after which barrel assembly 43*a* can be moved into position with its projection 51*a* extending downwardly into the magazine recess in the receiver, and with element 52*a* connected to projection 51*a*. Rod 53*a* and its connected parts may then be attached to element 52*a*, with the rod and connected parts being tightened to pull part 44*a* of the barrel assembly tightly downwardly against the receiver surfaces in front of and behind the magazine recess, with simultaneous automatic camming of U-shaped part 52*a* to an increased width condition bearing tightly against the opposite side walls of the magazine recess and attaining a highly effective overall rigid connection between the barrel and receiver. The slide may then be inserted forwardly onto the receiver, with the side rails 85*a* of the slide moving along opposite sides of the barrel assembly and slideably engaging the ribs and grooves of the receiver, and with the detent element 118 being deflected to pass part 44*a* and move to a position in front of that part and then automatically being returned by its spring 122 to a position thereafter preventing rearward movement of the slide beyond the discussed limiting position except when and if the detent element is intentionally released for removal of the slide.

In both forms of the invention, recoiling forces are transmitted from the barrel assembly to the receiver by engagement of generally vertically extending shoulders on these parts. In the first form of the invention, these recoiling forces are transmitted from an inclined rear surface 151 on projection 51 to the correspondingly inclined planar rear wall surface 32 of magazine recess 12. As will be apparent from FIG. 3, the inclination of these engaging surfaces tends to cam the barrel downwardly relative to the receiver under the influence of recoiling forces in a manner assuring maintenance of a rigid connection between the parts upon firing. In the second form of the invention, the recoiling forces are similarly transmitted from an inclined rear planar surface 151*a* of projection 51*a* to the corresondingly inclined rear wall of the magazine recess.

While certain specific embodiments of the present invention have been disclosed as typical, the invention is of course not limited to these particular forms, but rather is applicable broadly to all such variations as fall within the scope of the appended claims.

I claim:

1. For use with a pistol receiver having a handle portion containing a recess for receiving a magazine holding a series of rounds of ammunition, conversion apparatus comprising:

a barrel formed separately from said receiver;

a connector structure having a portion received within said magazine recess in said handle portion of the receiver, with the magazine removed therefrom, and acting to detachably secure said barrel to the receiver; and a bolt movable relative to said barrel.

2. Conversion apparatus as recited in claim 1, in which said connector structure includes an elongated unit extending downwardly through said recess, a bottom member connected to said elongated unit and disposed across a lower portion of said recess and acting upwardly against a lower portion of the receiver, a manually rotatable tightening element connected to the lower end of said elongated unit and acting upwardly against said bottom member, and a threaded connection for tightening the connection between said receiver and said barrel upon rotation of said tightening element.

3. Conversion apparatus as recited in claim 1, in which said portion of the connector structure within said magazine recess in said handle portion of the receiver is expansible laterally to an increased width condition bearing in opposite directions against opposite walls of said recess to maintain said portion of the connector structure in rigidly fixed position within the recess.

4. Conversion apparatus as recited in claim 1, in which said connector structure includes an expansible assembly receivable within said recess and including a first cam element connected to said barrel and a second cam element adjustably connected to said receiver and operable by downward actuation relative thereto to expand said expansible assembly to an increased width condition tightly engaging opposite walls of said recess and maintaining said expansible assembly in rigidly fixed position within the recess.

5. Conversion apparatus as recited in claim 1, in which said connector structure includes a projection connected to the barrel and extending downwardly within said magazine recess, an element within the recess engaging said projection, means connected to said element and engaged with the receiver in a relation to pull said element downwardly relative to the receiver, and cam surfaces on said projection and element acting upon downward movement of said element to pull the barrel tightly downwardly against the receiver and simultaneously cam said element and projection relative to one another in a manner increasing their combined effective width and applying force against opposite walls of the recess to retain said projection and element and the connected barrel in rigidly fixed position relative to the receiver.

6. Conversion apparatus as recited in claim 1, in which said barrel has a structure at its rear having downwardly facing surfaces engaging upwardly facing surfaces on the receiver near the upper end of said recess, said connector structure being operable to pull said structure at the rear of the barrel downwardly and thereby tighten said downwardly facing surfaces against said upwardly facing surfaces in a manner holding the barrel in rigidly fixed position relative to the receiver.

7. Conversion apparatus as recited in claim 6, in which said downwardly facing surfaces include a forward downwardly projecting curved surface engageable with a correspondingly curved one of said upwardly projecting surfaces formed on the receiver forwardly of said recess, and a rear downwardly facing surface engageable with a second of said upwardly facing surfaces rearwardly of the recess.

8. Conversion apparatus as recited in claim 1, in which said barrel has a structure at its rear with downwardly facing surfaces at the front and rear respectively of said recess pulled tightly downwardly against upwardly facing surfaces of the receiver by said connector structure.

9. Conversion apparatus as recited in claim 1, including a slide carrying said bolt and having two spaced opposite side portions guided for front to rear movement relative to the receiver and barrel, and a detent element mounted to one of said side portions of the slide and movable relative thereto between an active position in which it limits rearward movement of the slide and a released position permitting rearward removal of the slide from the receiver.

10. Conversion apparatus as recited in claim 1, including an element received within a forward portion of said receiver forwardly of said recess and having a portion at the underside of the barrel and a connecting portion containing an opening receiving a pin extending transversely through aligned openings in the receiver to secure said element to the receiver.

11. Conversion apparatus as recited in claim 1, in which said connector structure includes an elongated element extending downwardly through the recess toward the bottom of the receiver, a bottom wall urged upwardly by said elongated element and extending across the lower end of said recess and applying upward force to the lower end of the receiver, a tightening member at the underside of said bottom wall and rotatable relative thereto to tighten the connection through said elongated element between the receiver and barrel, and a handle part for manually rotating said tightening member and connected pivotally thereto for swinging movement between a lower active position in which it is manually rotatable and an upper retracted position adjacent the bottom wall.

12. Conversion apparatus as recited in claim 11, in which said bottom wall and said handle part interfit in said retracted position of the latter in a relation preventing rotary movement of the handle part and tightening member relative to the bottom wall and receiver.

13. Conversion apparatus as recited in claim 1, in which said connector structure includes two laterally spaced walls attached to the barrel and projecting downwardly into said recess, and an element tightenable downwardly relative to said walls and received therebetween and having a camming relation therewith acting upon downward movement to cam said walls laterally apart and tightly against the side walls of the receiver within said recess.

14. Conversion apparatus as recited in claim 1, in which said connector structure includes a projection connected to said barrel and projecting downwardly into said recess, and an element tightenable downwardly relative to said projection and having two spaced walls at opposite sides thereof and having camming surfaces engaging coacting camming surfaces on said projection in a relation acting upon downward movement of said walls to spread them laterally apart and tightly against side walls of the receiver within said recess.

15. Conversion apparatus as recited in claim 1, in which said portion of the connector structure received within said recess is anchored to the receiver and is manually adjustable to pull the barrel downwardly relative to the receiver for rigid connection thereto.

16. Conversion apparatus as recited in claim 1, in which said portion of the connector structure received within said recess carries a shoulder exerting force upwardly against said receiver at a location spaced beneath the top of said recess.

17. Conversion apparatus as recited in claim 1, in which said portion of the connector structure received within said recess carries a shoulder exerting force upwardly against said receiver at a location spaced beneath the top of said recess, and includes a threaded connection for tightening said shoulder upwardly relative to said barrel to retain the barrel in fixed position relative to the receiver.

18. Conversion apparatus as recited in claim 1, in which said portion of the connector structure received within said recess includes a threaded fastener which is threadedly adjustable upwardly and downwardly relative to said barrel, said connector structure including a member having a shoulder exerting force upwardly against said receiver at a location spaced beneath the top of said recess and which is tightenable upwardly by threaded adjustment of said fastener to secure the barrel in rigidly fixed position relative to the receiver.

19. Conversion apparatus as recited in claim 1, including a slide mounted for front to rear sliding movement relative to said barrel and movably carrying said bolt.

20. Conversion apparatus as recited in claim 1, including a slide mounted for front to rear movement relative to said barrel, and means attaching said bolt to said slide for front to rear movement therewith and for rotary movement relative thereto.

21. A converted gun comprising:

a pistol receiver having a handle portion containing a recess for receiving a magazine holding a series of rounds of ammunition, but with said magazine removed therefrom;

a barrel formed separately from said receiver;

a connector structure having a portion received within said magazine recess in said handle portion of the receiver and acting to detachably secure said barrel to the receiver; and a bolt mounted for movement relative to said barrel.

22. A converted gun as recited in claim 21, in which said portion of the connector structure received within said recess is anchored to the receiver and is tightenable to pull the barrel downwardly relative to the receiver for rigid connection thereto.

23. A converted gun as recited in claim 21, in which said portion of the connector structure received within said recess carries a shoulder exerting force upwardly against said receiver at a location spaced beneath the top of said recess.

24. A converted gun as recited in claim 21, in which said portion of the connector structure received within said recess carries a shoulder exerting force upwardly against said receiver at a location spaced beneath the top of said recess and includes a threaded connection for tightening said shoulder upwardly relative to said barrel to retain the barrel in fixed position relative to the receiver.

25. A converted gun as recited in claim 21, in which said portion of the connector structure within said recess includes a threaded fastener which is threadedly adjustable upwardly and downwardly relative to said barrel, said connector structure including a member having a shoulder exerting force upwardly against said receiver at a location spaced beneath the top of said recess and which is tightenable upwardly by threaded adjustment of said fastener to secure the barrel in rigidly fixed position relative to the receiver.

26. A converted gun as recited in claim 21, including a slide mounted for front to rear sliding movement relative to said barrel and movably carrying said bolt.

27. A converted gun as recited in claim 21, including a slide mounted for front to rear movement relative to said barrel, and means attaching said bolt to said slide for front to rear movement therewith and for rotary movement relative thereto.

28. A converted gun as recited in claim 21, in which said connector structure includes an elongated unit extending downwardly through said recess, a bottom member connected to said elongated unit and disposed across a lower portion of said recess and acting upwardly against a lower portion of the receiver, a manually rotatable tightening element connected to the lower end of said elongated unit and acting upwardly against said bottom member, and a threaded connection for tightening said bottom member upwardly and thereby tightening the connection between said receiver and said barrel upon rotation of said tightening element.

29. A converted gun as recited in claim 21, in which said portion of the connector structure within said recess in said handle portion of the pistol receiver is expanded laterally to an increased width condition bearing in opposite directions against opposite walls of said recess to maintain said portion of the connector structure in rigidly fixed position within the recess.

30. A converted gun as recited in claim 21, in which said barrel has a structure at its rear having downwardly facing surfaces near said recess pulled tightly downwardly against upwardly facing surfaces of the receiver by said connector structure.

31. A converted gun as recited in claim 21, including a slide carrying said bolt and having two spaced side portions extending along opposite sides of said barrel, there being interfitting ribs and grooves guiding the slide for front to rear movement relative to the receiver and barrel.

32. For use with a pistol receiver carrying a trigger and firing mechanism and having a downwardly extending handle portion containing a recess for receiving a magazine holding a series of rounds of ammunition, with said receiver having upwardly facing surfaces at the upper end of said recess and having side walls defining opposite sides of the recess, conversion apparatus comprising:

a barrel carrying a structure at its rear extending across the upper end of said recess and having downwardly facing surfaces engageable with said upwardly facing surfaces of the receiver and having a first connector projecting downwardly into said recess, with said magazine removed from the recess;

a second connector within said recess and engaging said first connector to apply downward force thereto in a relation tightening said downwardly facing surfaces against said upwardly facing surfaces and retaining the barrel in rigidly fixed position relative to the receiver;

an elongated unit extending downwardly from said second connector within said recess and applying downward force thereto;

a bottom member at the lower end of the recess and pulled upwardly by said elongated unit to apply upward force to the lower portion of the receiver and tighten the barrel on the receiver;

a manually actuable part rotatable at the underside of said bottom member and tightenable upwardly thereagainst on such rotation;

a threaded connection for tightening the manually actuable part upwardly against said bottom member upon said rotation;

a slide having opposite side walls received at opposite sides of said barrel and receiver, and mounted for front to rear sliding movement relative to the receiver and barrel; and a bolt carried by said slide for front to rear movement therewith and for rotary movement relative thereto and acting in a forward position to close the rear end of the barrel.

33. Conversion apparatus as recited in claim 32, in which one of said connectors includes two laterally spaced walls engaging said opposite side walls of the receiver within said recess, the other connector being received between said side walls of said one connector and having a camming relation therewith acting upon application of downward force to said second connector by said elongated unit to cam said walls of said one connector laterally apart and tightly against the side walls of the receiver within said recess.

34. Conversion apparatus as recited in claim 33, in whcih said threaded connection is formed between an upper end of said elongated unit and said second connector.

35. Conversion apparatus as recited in claim 34, including a second threaded connection attaching the lower end of said elongated unit adjustably to said manually actuable part.

36. The conbination comprising conversion apparatus as recited in claim 32, and said receiver as an element of the claim connected to said conversion apparatus.

* * * * *